US009278275B1

(12) United States Patent
Braithwaite

(10) Patent No.: US 9,278,275 B1
(45) Date of Patent: Mar. 8, 2016

(54) ATHLETIC MOUTHGUARD HOLDER

(71) Applicant: Neil Jennings Braithwaite, Matthews, NC (US)

(72) Inventor: Neil Jennings Braithwaite, Matthews, NC (US)

( * ) Notice: Subject to any disclaimer, the term of this patent is extended or adjusted under 35 U.S.C. 154(b) by 0 days.

(21) Appl. No.: 14/560,241

(22) Filed: Dec. 4, 2014

(51) Int. Cl.

| | |
|---|---|
| ***A63B 71/10*** | (2006.01) |
| ***A63B 71/08*** | (2006.01) |
| ***A42B 3/04*** | (2006.01) |
| *A42B 1/24* | (2006.01) |

(52) U.S. Cl.
CPC ..... *A63B 71/085* (2013.01); *A42B 3/0406* (2013.01)

(58) Field of Classification Search
CPC ..... A63B 71/085; A63B 2071/088; A63B 2209/08; A63B 2071/086; A63B 2208/12; A63B 2243/0045; A63B 2243/0066; A63B 71/0036; A63B 2243/0025; A63B 2243/005; A63B 71/10; A61C 7/08; A61C 19/02; A61C 5/14; A42B 3/0406; A42B 3/205; Y10T 24/13
See application file for complete search history.

(56) References Cited

U.S. PATENT DOCUMENTS

| | | | | |
|---|---|---|---|---|
| 3,448,738 | A * | 6/1969 | Berghash | 128/861 |
| 3,682,164 | A * | 8/1972 | Miller | 128/857 |
| 4,977,905 | A * | 12/1990 | Kittelsen et al. | 128/861 |
| 5,234,005 | A * | 8/1993 | Kittelsen et al. | 128/859 |
| 5,293,880 | A * | 3/1994 | Levitt | 128/861 |
| 5,365,946 | A * | 11/1994 | McMillan | 128/861 |
| 6,932,088 | B1 * | 8/2005 | Berghash | 128/861 |
| 8,074,658 | B2 * | 12/2011 | Kittelsen et al. | 128/861 |
| 8,191,178 | B2 * | 6/2012 | Mangel, Jr. | 2/422 |
| 2002/0144687 | A1 * | 10/2002 | Kittelsen et al. | 128/859 |
| 2002/0144688 | A1 * | 10/2002 | Kittelsen et al. | 128/859 |
| 2002/0144690 | A1 * | 10/2002 | Kittelsen et al. | 128/861 |
| 2003/0111083 | A1 * | 6/2003 | Bancroft | 128/859 |
| 2003/0136416 | A1 * | 7/2003 | White | 128/859 |
| 2003/0154990 | A1 * | 8/2003 | Parker | 128/861 |
| 2004/0076219 | A1 * | 4/2004 | Madison et al. | 374/159 |
| 2004/0103905 | A1 * | 6/2004 | Farrell | 128/861 |
| 2004/0244805 | A1 * | 12/2004 | Cook et al. | 128/859 |
| 2004/0250817 | A1 * | 12/2004 | Kittelsen et al. | 128/861 |
| 2006/0201520 | A1 * | 9/2006 | Christensen, III | 128/848 |
| 2008/0092277 | A1 * | 4/2008 | Kraemer et al. | 2/421 |
| 2009/0223526 | A1 * | 9/2009 | Berghash et al. | 128/861 |
| 2011/0155146 | A1 * | 6/2011 | Marsh | 128/861 |
| 2012/0279506 | A1 * | 11/2012 | Thompson et al. | 128/861 |
| 2012/0285473 | A1 * | 11/2012 | Wright | 128/862 |
| 2013/0066236 | A1 * | 3/2013 | Herman et al. | 600/595 |
| 2014/0083435 | A1 * | 3/2014 | Dorphley | 128/861 |
| 2014/0174456 | A1 * | 6/2014 | Bentley, Jr. | 128/861 |
| 2014/0345626 | A1 * | 11/2014 | Brett et al. | 128/861 |
| 2015/0209645 | A1 * | 7/2015 | Zents | 128/861 |
| 2015/0258417 | A1 * | 9/2015 | Rodgers et al. | 128/861 |

* cited by examiner

*Primary Examiner* — Bobby Muromoto, Jr.
(74) *Attorney, Agent, or Firm* — Bradley C. Fach; Steven R. Kick; PatentFile, LLC

(57) ABSTRACT

A mouthguard holder for temporarily securing an athletic mouthguard to an exterior side of a helmet is provided. The mouthguard holder generally comprising: a support post base adapted to contact the exterior surface of the helmet, a support post with a first end and second end, a retaining member coupled to the support post at the support post second end the retaining member radially extending out away from the support post forming a mouthguard receiving pocket between the support post base and the retaining member where the receiving pocket is adapted to removably secure a mouthguard to the exterior side of the helmet.

15 Claims, 5 Drawing Sheets

ATHLETIC MOUTHGUARD HOLDER

FIELD OF THE INVENTION

The present patent specification relates to the field of athletic equipment. More specifically, the specification relates to novel holders for mouthguards which are commonly used in contact sporting events such as football, hockey, lacrosse, and the like.

BACKGROUND

Mouthguards provide a vital role in ensuring the safety of athletes and the use of mouthguards has become highly recommended for any athlete who plays a sport involving physical contact such as American football. The known risk of oral injury to teeth, mouth, gums and jaw associated with contact sports has driven the market for mouthguards among athletes who play contact sports. Recent research has shown that the use of a mouthguard can also reduce the risk of brain trauma, better known as concussion. Often the use of a mouthguard is mandated by an athletic association, league or team to qualify to compete in a particular sport.

Over the years, the mouthguard has seen some design changes to enhance the oral safety and protection of an athlete. But one thing has not changed over the years. Since the invention of the mouthguard, there are still only two basic types of mouthguards on the market. One that is designed to be tethered to a helmet with a strap connecting it to the faceguard or facemask, and one that is non-tethered that has no designed means of securing it to a helmet.

Consequently, based on today's athletic mouthguard market, an athlete has only one choice if they want a mouthguard that can be secured to a helmet during participation in a sporting event when it is not in their mouth. Unfortunately, if an athlete chooses a non-tethered mouthguard with no designed means of securing it to a helmet they are left to improvise a means to secure the mouthguard when not in use.

Because the majority of athletes today choose to use a non-tethered type of mouthguard, there is a great need for new means to secure these types of mouthguards when not in use during a game or at practice. Using a non-tethered mouthguard leaves athletes with only several undesirable options to secure it when it is out of their mouth, for example; the athlete either wedges the mouthguard between the helmet surface and a bar of the facemask, wedges it between two bars of the facemask, stuffs it inside their belt or sock, puts it behind their ear, leaves it in their mouth and chews on it, or they simply hold it in their hand. Unfortunately, all the options an athlete has to secure a non-tethered mouthguard are driven by necessity—not by design. Therefore, what is needed in field is a mouthguard holder which is able to secure an un-tethered mouthguard to the surface of a helmet thereby providing a safe and effective means for athletes to temporarily store their mouthguards when not in use.

BRIEF SUMMARY OF THE INVENTION

A mouthguard holder for temporarily securing an athletic mouthguard to an exterior side of a helmet is provided. The mouthguard holder generally comprising: a support post base adapted to contact the exterior surface of the helmet, a support post with a first end and second end, a retaining member coupled to the support post at the support post second end the retaining member radially extending out away from the support post forming a mouthguard receiving pocket between the support post base and the retaining member where the receiving pocket is adapted to removably secure a mouthguard to the exterior side of the helmet.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New devices and apparatuses referred to as "mouthguard holders" or "the mouthguard holder" or sometimes "holder" or "the holder" are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
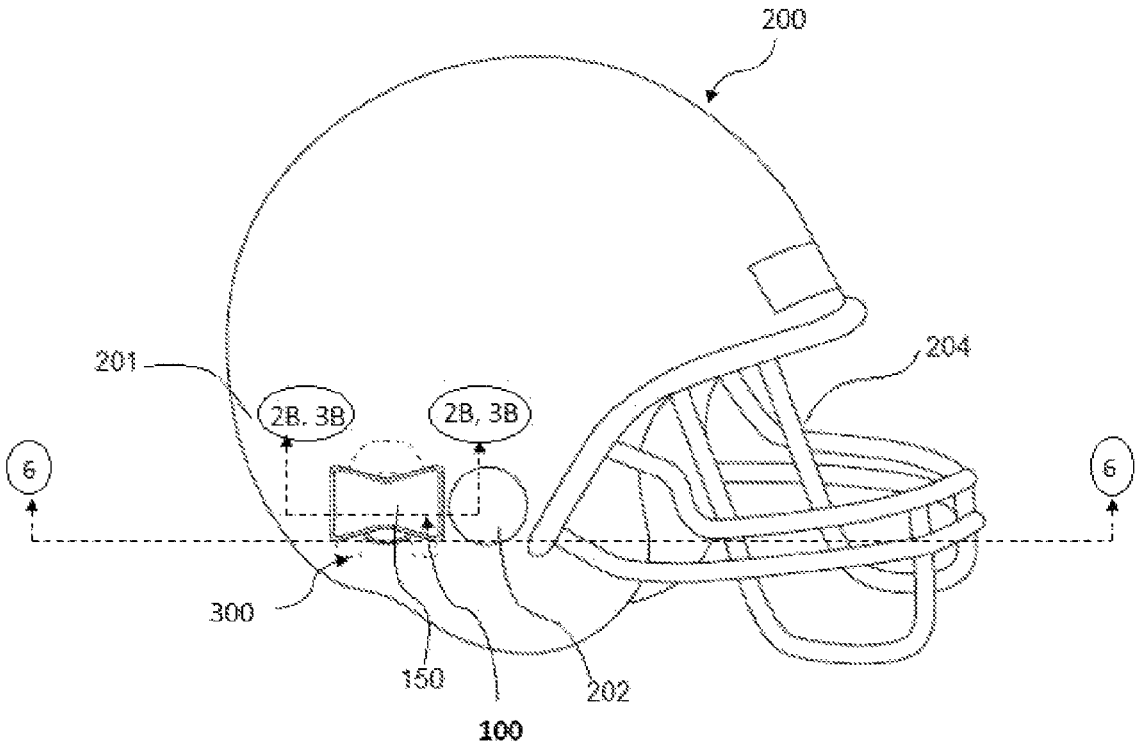
FIG. 1 depicts an side perspective view of an example of a mouthguard holder mounted to a side of a helmet according to various embodiments of the present invention.

The present invention will now be described by referencing the appended figures representing preferred embodiments. FIG. 1 shows a side perspective view of a helmet 200 with a mouthguard holder 100 mounted onto the helmets surface 201. A representation of a mouthguard 300 is shown in broken lines. Although an American style football helmet 200 is shown by the figures, other types of helmets 200 such as hockey helmets, lacrosse helmets, cycling helmets, driving helmets, etc. and the like are contemplated herein and the invention should not be unintentionally limited to only one type of helmet. The helmet surface 201 is preferably a smooth and rigid or semi rigid material such as hard plastic configured to provide protection against impact forces to the head of an athlete. In preferred embodiments, the mouthguard holder 100 is removably coupled to the helmet surface 201 at a location proximate to the ear hole 202. In some alternative embodiments, the mouthguard holder 201 may be permanently coupled or affixed to the helmet surface 201.

As perhaps best shown by FIG. 1, the mouthguard holder 100 is coupled to the helmet surface 201 at one side of a helmet 200. An athlete wearing a mouthguard 300 may simply remove the mouthguard 300 from their mouth and removably couple it to the mouthguard holder 100 by pressing it into a receiving pocket 110 (FIG. 2 and FIG. 3) where it is held in place by frictional forces by the mouthguard retaining member 150 portion of the mouthguard holder 100. The mouthguard 300 is held in place by frictional forces until the athlete is ready to use it at which point the athlete will slightly pull on the mouthguard 300 releasing it from the receiving pocket 110 and placing it into their mouth before a starting their contact activity.

Figure 2A:
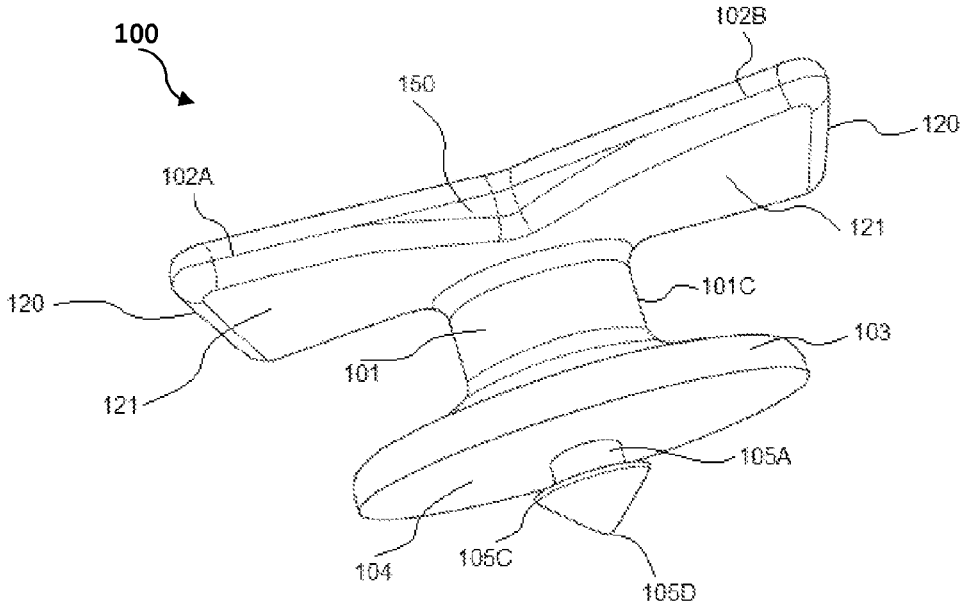
FIG. 2A illustrates a side perspective view of a mouthguard holder having a locking pin according to various embodiments of the present invention.
Figure 2B:
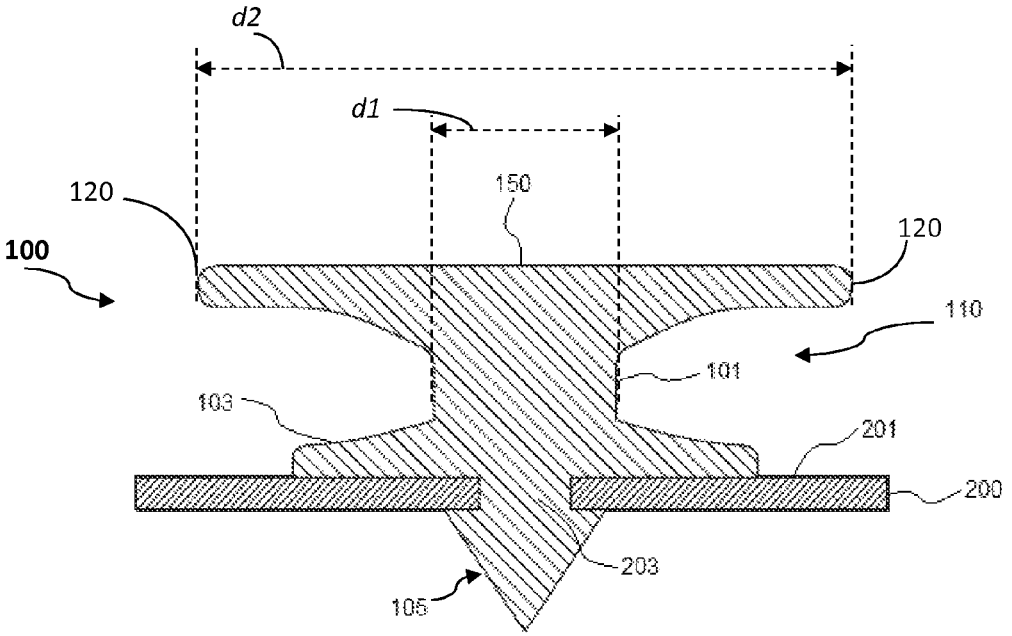
FIG. 2B illustrates a side cross sectional view through line 2B (FIG. 1) of a mouthguard holder having a locking pin according to various embodiments of the present invention.

Referring now to FIG. 2A and FIG. 2B, in FIG. 2A a side perspective view showing one embodiment of a mouthguard holder 100 is provided. In this embodiments, the mouthguard holder 100 comprises a retaining member 150 (FIG. 1) made up of two retaining wings 102A and 102B, a support post 101 coupled to the two retaining wings 102A and 102B, a post base 103 coupled to the support post 101, and a locking pin 105 coupled to and protruding below the post base 103. In this example, the mouthguard retaining member 150 (FIG. 1) comprises a first retaining wing 102A radially extending out from the support post 101 at its first end (top end furthest from the post base 103), the first retaining wing 102A having a wing distal end 120, a wing bottom surface 121, and a wing top surface 122 and also in this example the mouthguard retaining member 150 further comprises a second retaining wing 102B radially extending out from the support post 101 at its first end (top end) and opposite to the first retaining wing 102A, the second retaining wing having a wing distal end 120, a wing bottom surface 121, and a wing top surface 122. In this and in preferred embodiments, the support post 101 has a maximum width of a first distance (d1) and the retaining member has a minimum width a second distance (d2) measured from the distal end 120 of the first retaining wing 102A to the distal tip 120 of the second retaining wing 102B and wherein the first distance (d1) is less than the second distance (d2) thereby creating a top retaining surface for a mouthguard receiving pocket 110. In some embodiments, the second distance (d2) is at least twice as great as the first distance (d1). Although the retaining member 150 with two retaining wings 102A and 102B are shown with a butterfly type design, other designs are contemplated herein. For example, the retaining member 150 may be square shaped, rectangular shaped, circular shaped, oval shaped, or other geometric or non-geometric shapes but preferably has at least one dimension (width or length) greater than the maximum width of the support post 101. In preferred embodiments, the retaining member 150 comprises one, two, three, four, five, six, or more retaining wings 102 which each retaining wing 102 extending latterly out at a substantially perpendicular orientation to the support post 101 thereby forming a retaining surface for a mouthguard 300 when placed into the receiving pocket 110. Each retaining wing 102 may be shaped in a wing shape, or may be square shaped, rectangular shaped, circular shaped, oval shaped, or other geometric or non-geometric shapes. Each retaining wing 102 generally extends radially out from the first end (top end) of the support post 101 in a manner substantially parallel with the post base 102 thereby forming a mouthguard receiving pocket 110 with said receiving pocket 110 bordered on one side by the wing bottom surfaces 121 and bordered on an opposite side by the post base 103 or optionally in some embodiments the helmet surface 201. The support post 101 as shown by the figures is preferably round or cylindrical but other shaped support posts 101 are contemplated herein. In preferred embodiments, the support post 101 has a curved lateral surface 101C on at least one side adapted to be complementary to and receive the round interior end 301 (FIGS. 4A and 4B) of a mouthguard 300 and is of sustainably the same curvature and diameter as the round interior end 301 a mouthguard 300 thereby providing a mounting location for the mouthguard 300 when placed into the receiving pocket 110 of the mouthguard holder 100 and preventing the mouthguard 300 from falling or disengaging from the holder 100. The support post 101 is preferably coupled to a post base 103 at its second end (lower end furthest from the retaining member 150). In some preferred embodiments, the post base 103 has a top surface and a bottom attachment surface 104 with said attachment surface 104 configured to contact the helmet surface 201. In this embodiment, post base 103 is preferably round and the attachment surface 104 is preferably smooth to facilitate mating with a smooth helmet surface 201. To the extent a helmet surface 201 may be curved or contoured, the attachment surface 104 may have complementary curves or contours to facilitate a flush mounting between the two elements. The post base 103 and in particular the post base attachment surface 104 may be made from a elastomeric plastic or rubber with a degree of flexibility to facilitate a flush mounting against a helmet surface 201 which is often curved at various locations.

Referring now also to FIG. 2B, a side cross sectional view of a mouthguard holder 100, a helmet 200, and helmet surface 201 is provided. In this embodiment, the mouthguard holder 100 is removably coupled to the helmet by inserting a locking pin 105 into a helmet aperture 203 through the helmet surface 201. The locking pin 105 in this example is coupled to the post base 103 at its top end then extends vertically below the post base attachment surface 104. The locking pin 105 may comprise a pin shaft 105A (FIG. 2A), a pin base 105C (FIG. 2A) and terminate with a pointed tip 105D. In preferred embodiments, the locking pin 105 is constructed from of a resilient material such as elastomer plastics, rubbers, foams, and the like allowing the locking pin to transition from a first compressed position to a second uncompressed position. Furthermore, locking pin base 105C preferably has a width in the second uncompressed position greater than the diameter of the helmet aperture 203 thereby preventing the locking pin 105 from inadvertently disengaging from the helmet 200.

Figure 3A:
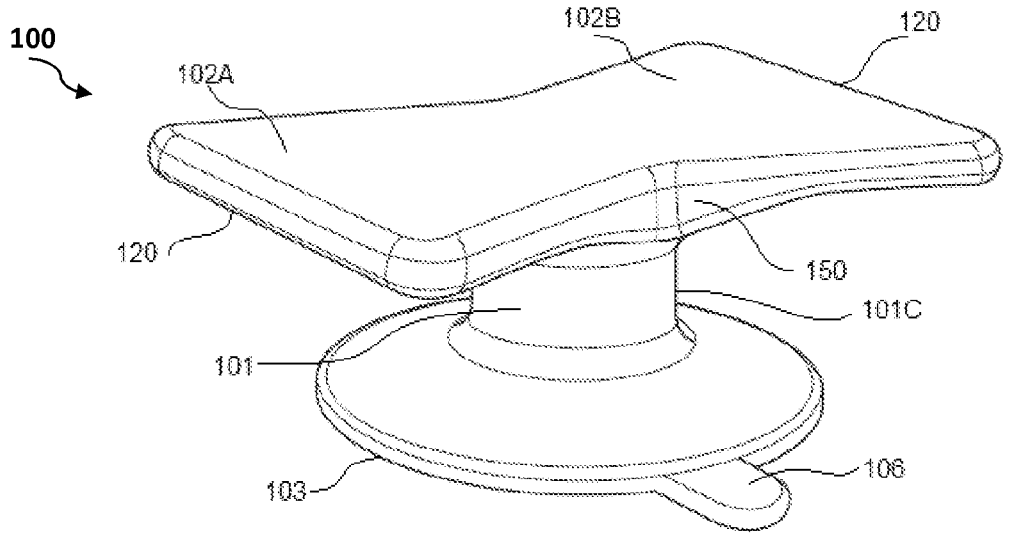
FIG. 3A illustrates a side perspective view of a mouthguard holder having an attachment surface with pull tab according to various embodiments of the present invention.
Figure 3B:
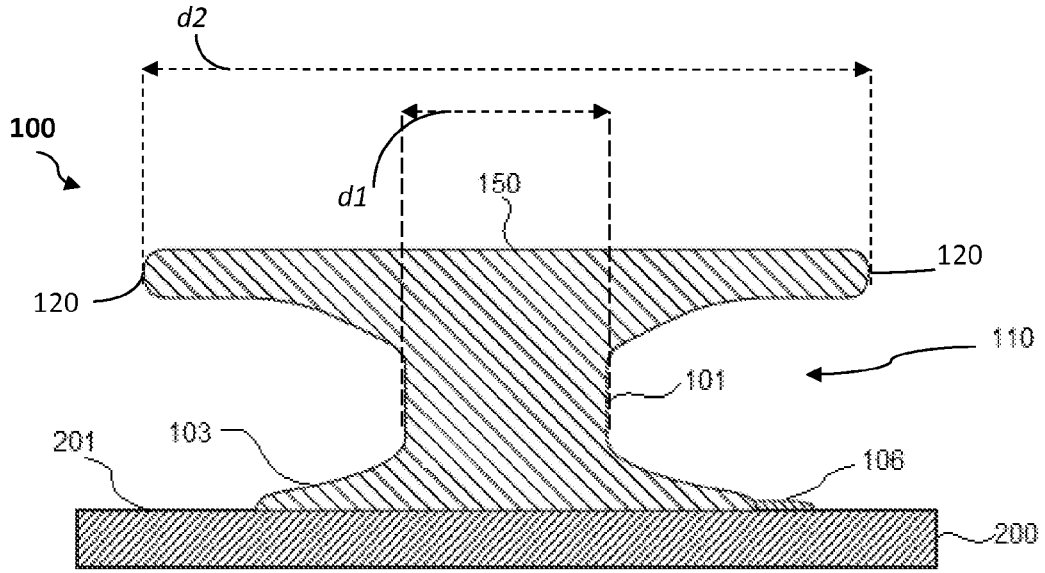
FIG. 3B illustrates a side cross sectional view through line 3B (FIG. 1) of a mouthguard holder having an attachment surface with pull tab according to various embodiments of the present invention.

Referring now to FIG. 3A and FIG. 3B, in FIG. 3A a side perspective view showing one embodiment of a mouthguard holder 100 is provided. In this embodiments, the mouthguard holder 100 comprises a retaining member 150 (FIG. 1) made up of two retaining wings 102A and 102B, a support post 101 coupled to the two retaining wings 102A and 102B, a post base 103 coupled to the support post 101, and a pull tab 106 coupled to and protruding from the distal end of the post base 103. In this example, the mouthguard retaining member 150 (FIG. 1) comprises a first retaining wing 102A radially extending out from the support post 101 at its first end (top end furthest from the post base 103), the first retaining wing 102A having a wing distal end 120, a wing bottom surface 121, and a wing top surface 122 and also in this example the mouthguard retaining member 150 further comprises a second retaining wing 102B radially extending out from the support post 101 at its first end (top end) and opposite to the first retaining wing 102A, the second retaining wing having a wing distal end 120, a wing bottom surface 121, and a wing top surface 122. In this and in preferred embodiments, the support post 101 has a maximum width of a first distance (d1) and the retaining member has a minimum width a second distance (d2) measured from the distal end 120 of the first retaining wing 102A to the distal tip 120 of the second retaining wing 102B and wherein the first distance (d1) is less than the second distance (d2) thereby creating a top retaining surface for a mouthguard receiving pocket 110. In some embodiments, the second distance (d2) is at least twice as great as the first distance (d1). Although the retaining member 150 with two retaining wings 102A and 102B are shown with a butterfly type design, other designs are contemplated herein. For example, the retaining member 150 may be square shaped, rectangular shaped, circular shaped, oval shaped, or other geometric or non-geometric shapes but preferably has at least one dimension (width or length) greater than the maximum width of the support post 101. In preferred embodiments, the retaining member 150 comprises one, two, three, four, five, six, or more retaining wings 102 which each retaining wing 102 extending latterly out at a substantially perpendicular orientation to the support post 101 thereby forming a retaining surface for a mouthguard 300 when placed into the receiving pocket 110. Each retaining wing 102 may be shaped in a wing shape, or may be square shaped, rectangular shaped, circular shaped, oval shaped, or other geometric or non-geometric shapes. Each retaining wing 102 generally extends radially out from the first end (top end) of the support post 101 in a manner substantially parallel with the post base 102 thereby forming a mouthguard receiving pocket 110 with said receiving pocket 110 bordered on one side by the wing bottom surfaces 121 and bordered on an opposite side by the post base 103 or optionally in some embodiments the helmet surface 201. The support post 101 as shown by the figures is preferably round or cylindrical but other shaped support posts 101 are contemplated herein. In preferred embodiments, the support post 101 has a curved lateral surface 101C on at least one side adapted to be complementary to and receive the round interior end 301 (FIGS. 4A and 4B) of a mouthguard 300 and is of sustainably the same curvature and diameter as the round interior end 301 a mouthguard 300 thereby providing a mounting location for the mouthguard 300 when placed into the receiving pocket 110 of the mouthguard holder 100 and preventing the mouthguard 300 from falling or disengaging from the holder 100. The support post 101 is preferably coupled to a post base 103 at its second end (lower end furthest from the retaining member 150). In some preferred embodiments, the post base 103 has a top surface and a bottom attachment surface 104 with said attachment surface 104 configured to contact the helmet surface 201. In this embodiment, post base 103 is preferably round and the attachment surface 104 is preferably smooth to facilitate mating with a smooth helmet surface 201. To the extent a helmet surface 201 may be curved or contoured, the attachment surface 104 may have complementary curves or contours to facilitate a flush mounting between the two elements. The post base 103 and in particular the post base attachment surface 104 may be made from a elastomeric plastic or rubber with a degree of flexibility to facilitate a flush mounting against a helmet surface 201 which is often curved at various locations. In this regard, vacuum or suctional forces may be employed to temporally couple the mouthguard holder 100 to the helmet surface 201. Also in this embodiment, the post base bottom attachment surface 104 may comprise an adhesive such as 104A (FIG. 6) to further facilitate the coupling of the holder 100 to the helmet surface 201. A pull tab 106 may be positioned on an outside distal end of the post base 103 providing a convenient means for an athlete, coach, or other user to remove the mouthguard holder 100 from the helmet surface 201. The pull tab 106 is preferably integrally formed with and permanently coupled to the post base 103 and attachment surface 104 and may be of any suitable size or shape to provide a means for a user to pull the pull tab 106 and attachment surface 104 out and away from the helmet surface 201 thereby disengaging the mouthguard holder 100 from the helmet 200.

Figure 4A:
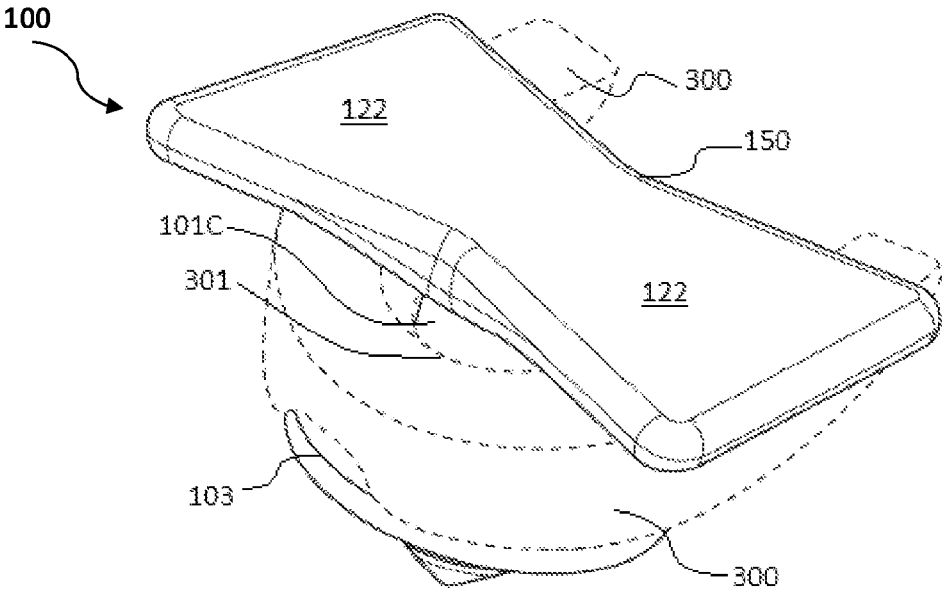
FIG. 4A shows a perspective view of a mouthguard removably secured to a mouthguard holder according to various embodiments described herein.
Figure 4B:
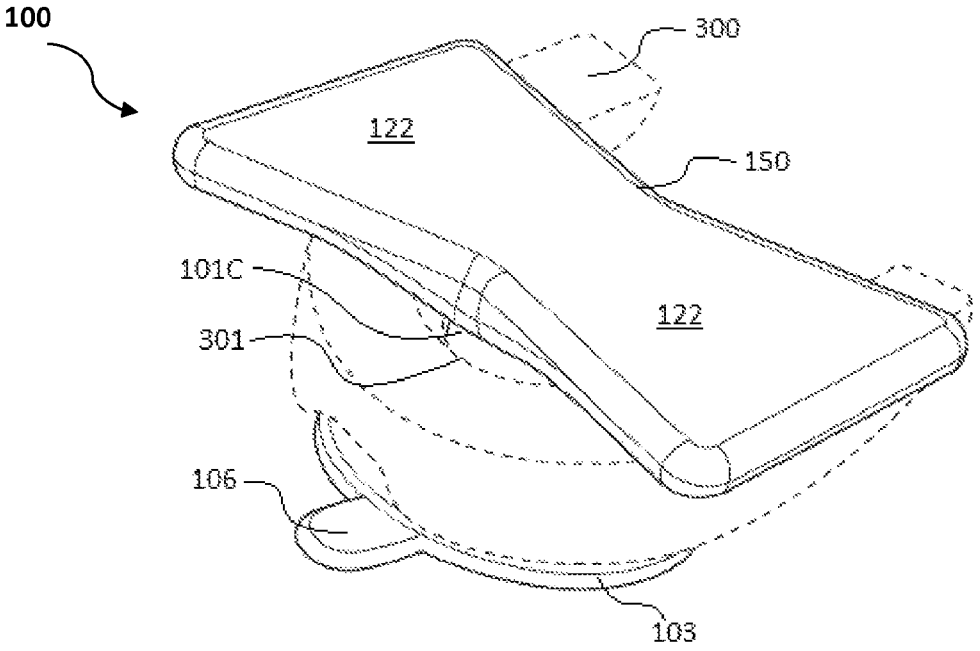
FIG. 4B shows a perspective view of a mouthguard removably secured to a mouthguard holder having a pull tab according to various embodiments described herein.

Referring now to FIG. 4A and FIG. 4B, a perspective view is provided showing an example of a mouthguard 300 (broken lines) engaged with a mouthguard holder 100. In this embodiment, the mouthguard retaining member comprises two retaining wings 102A and 102B with each wing having a wing top surface 122. A support post 101 with a curved lateral surface 101C is shown engaging with the curved interior side of the mouthguard 300 thereby preventing the mouthguard from moving about and inadvertently disengaging from the holder 100. Also shown by this example the retaining wings 102A and 102B serve as a barrier for the mouthguard 300 and prevent the mouthguard 300 from inadvertently disengaging from the holder 100. In the embodiment shown by FIG. 4A, the mouthguard holder 100 may be secured to the helmet surface 201 though a locking pin 105 inserted through a helmet aperture 203 (FIG. 2B) while in the embodiment shown by FIG. 4B, the mouthguard holder 100 may be secured to the helmet surface 201 by the post base bottom attachment surface 104 (FIG. 3) which may optionally contain an adhesive.

Figure 5:
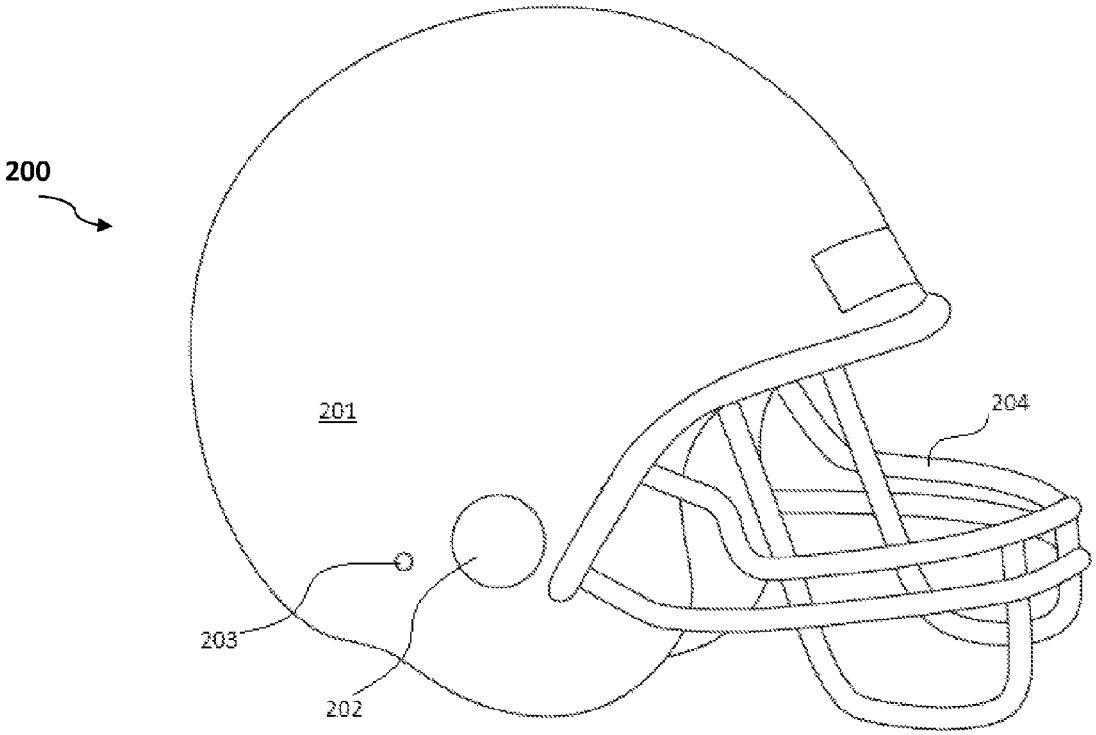
FIG. 5 illustrates a side perspective view of an exemplary helmet in accordance with various embodiments described herein.

Referring to FIG. 5, a side view of an American style football helmet 200 is shown. The helmet 200 in this example comprises a helmet surface 201, a helmet ear hole 202, a helmet aperture 203, and a facemask 204. Although an American style football helmet 200 is shown by the figures, other types and styles of athletic helmets may be employed by the mouthguard holder 100 of the present invention.

Figure 6:
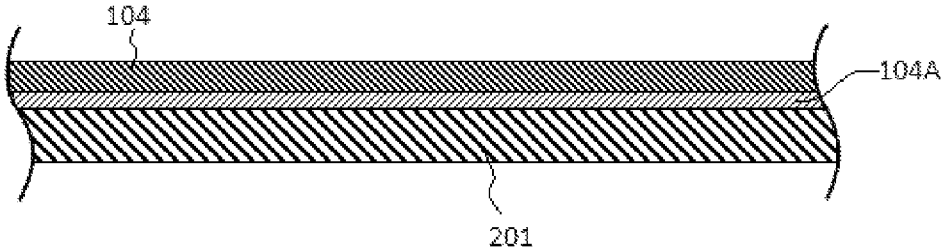
FIG. 6 is a sectional view through line 6 (FIG. 1) showing an example of a mouthguard holder base attachment surface coupled to the surface of a helmet using an adhesive.

FIG. 6 is a sectional view through line 6 (FIG. 1) showing an example of a mouthguard holder base attachment surface

104 coupled to a helmet surface 201 using an adhesive 104A. Adhesives used to assist in the coupling between the mouthguard holder 100 and the helmet surface 201 may include but are not limited to; doubled sided tape, differential adhesive tapes, natural adhesives including natural resins and bioadhesives or synthetic adhesives such as epoxy, polyurethane, cyanoacrylate and acrylic polymer based adhesives. While the term adhesive is used it should be understood that this term may at times be substituted for glues, cements, mucilages, or pastes.

While some preferred materials for elements have been described, the device is not limited by these materials. The elements that comprise the mouthguard holder including the retaining member 150, wings 102, support post 101, and post base 103 are preferably integrally formed (i.e. by a molding process) and may be constructed from flexible or durable materials such as polymeric materials, elastomers including rubbers, silcones, and soft plastics or in alternative embodiments hard plastics, metal alloys, wood, hard rubbers, carbon fiber, fiber glass, resins, polymers or any other suitable materials including combinations of materials may be used.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A mouthguard holder for removably securing a mouthguard to an exterior side of a helmet, the mouthguard holder comprising:

a. a support post base adapted to contact the exterior surface of the helmet;

b. a support post with a first end and second end, said first end coupled to the support post base;

c. a retaining member coupled to the support post at the support post second end and the retaining member radially extending out away from the support post, the retaining member comprising, (i) a first retaining wing extending out from the support post second end, the first retaining wing having a wing distal end, a wing bottom surface, and a wing top surface; and (ii) a second retaining wing radially extending out from the support post second end to the first retaining wing, the second retaining wing having a wing distal end, wing bottom surface, and a wing top surface; and wherein a receiving pocket is formed between the support post base and the retaining member, said receiving pocket adapted to removably secure the mouthguard to the exterior side of the helmet.

2. The mouthguard holder of claim 1, wherein the support post has a maximum width of a first distance (d1) and the retaining member has a minimum width a second distance (d2) measured from the distal end of the first retaining wing to the distal tip of the second retaining wing and wherein the first distance (d1) is less than the second distance (d2).

3. The mouthguard holder of claim 2, wherein the second distance (d2) is at least twice as great as the first distance (d1).

4. The mouthguard holder of claim 1, wherein the support post has a curved lateral surface adapted to receive the round interior surface of a mouthguard.

5. The mouthguard holder of claim 4, wherein the support post is cylindrical.

6. The mouthguard holder of claim 1, wherein the support post has a curved lateral surface adapted to receive the round interior surface of a mouthguard.

7. The mouthguard holder of claim 1, wherein the support post base is round with a top surface and a bottom attachment surface, the bottom attachment surface comprising an elastomeric material adapted to contour to the shape of the exterior surface of the helmet.

8. The mouthguard holder of claim 7, wherein the support post base bottom attachment surface contains an adhesive to secure the mouthguard holder to the helmet surface.

9. The mouthguard holder of claim 1, wherein the support post base is round with a center portion of a first thickness and a distal portion of a second thickness and wherein said first thickness is greater than said second thickness.

10. The mouthguard holder of claim 9, wherein the support post base contains a pull tab protruding out from the distal portion of said base.

11. The mouthguard holder of claim 1, wherein the support post base comprises a locking pin protruding below the support post base opposite to the support post and said locking pin configured enter a helmet aperture.

12. The mouthguard holder of claim 11, wherein the locking pin contains a pointed tip at one end and a pin base at a second end.

13. The mouthguard holder of claim 12, wherein the locking pin is configured as an inverted cone.

14. The mouthguard holder of claim 13, wherein the pin base is constructed with a resilient material configured to transition from a first compressed position to a second uncompressed position.

15. The mouthguard holder of claim 14, wherein the pin base has a width in the second uncompressed position greater than the diameter of the helmet aperture thereby preventing the locking pin from inadvertently disengaging from the helmet.

* * * * *